United States Patent [19]

Koyama

[11] 4,155,509

[45] May 22, 1979

[54] FOAM SPRAY FOR BEAUTY TREATMENT

[76] Inventor: Masaya Koyama, 4-go, 21-ban, 4-chome, Kizuri, Higashiosaka-shi, Osaka-fu, Japan

[21] Appl. No.: 755,260

[22] Filed: Dec. 29, 1976

[30] Foreign Application Priority Data

Oct. 22, 1976 [JP] Japan ..... 51-127483

[51] Int. Cl.[2] ..... B05B 7/26

[52] U.S. Cl. ..... 239/308; 222/399; 222/402.13; 239/373; 239/581

[58] Field of Search ..... 239/302–304, 239/308, 373, 581, 582; 222/189, 399, 402.13, 509, 531, 537

[56] References Cited

U.S. PATENT DOCUMENTS

| | | | |
|---|---|---|---|
| 2,862,765 | 12/1958 | Wing | 239/303 |
| 3,262,609 | 7/1966 | Poitras | 239/308 X |

*Primary Examiner*—Robert B. Reeves
*Assistant Examiner*—Andres Kashnikow
*Attorney, Agent, or Firm*—Wm. Jacquet Gribble

[57] ABSTRACT

A foam spray for beauty treatment comprising a spray main body having a mount for attaching a container containing a beauty treatment solution, a gas cylinder mounted in the spray main body, a gas flow regulator including a knob member for operating a valve on the gas cylinder, and a gas flow regulator sliding member coupled to the knob member. The gas flow regulator regulates the flow of gas into the container to adjust the rate of generation of the foam to be applied.

6 Claims, 4 Drawing Figures

FOAM SPRAY FOR BEAUTY TREATMENT

BACKGROUND OF THE INVENTION

1. Field of the Invention

This invention relates to a foam spray for beauty treatment including a cylinder containing a pressure gas and adapted to foam a beauty treatment solution with use of the gas and to apply the resulting foam.

2. Description of the Prior Art

Foam sprays heretofore used for beauty treatment for foaming a beauty treatment solution such as cold wave solution and applying the foam to the hair have the construction shown in FIG. 1 and are equipped with a liquefied gas cylinder having a valve of the generally known stem type. As illustrated, such sprays have a trigger 1 which, when pulled, moves the stem 3 of a gas cylinder 2 axially thereof, permitting a pressure gas to flow from the gas cylinder 2 into a container 4 containing a cold wave solution to foam the solution. The foamed solution is applied from a nozzle 5 to the head by the gas pressure. Because the foam spray of the trigger type foams the solution at a substantially constant rate, the foam is applied to the top of the head at the same rate as to the rear and side of the head. However, it is desired that the foamed solution be applied to the back and side of the head at a lower rate than to the top; otherwise the solution would flow down the scruff of the neck, giving a great discomfort to the customer. Furthermore, the conventional foam spray is not efficient to use, since the speed of application is not controllable in such manner that the foam is applicable speedily to the top of the head which is easy to treat while permitting application at a reduced speed to the back and side of the head which involves difficulty. The foam spray has another drawback of causing much fatigue to the user, because the trigger must be held in its actuated position for the 3 to 5 minutes which is usually required for the application of the permanent wave solution to the head.

SUMMARY OF THE INVENTION

This invention has overcome the foregoing drawbacks and provides a foam spray for beauty treatment having improved features heretofore desired.

The foam spray for beauty treatment of this invention comprises a spray main body having a mount for attaching a container containing a beauty treatment solution, a gas cylinder mounted in the spray main body a gas flow regulator including, a knob member for operating a valve on the gas cylinder, and a gas flow regulator sliding member coupled to the knob member for regulating the flow of gas into the container.

According to this invention, a knob member is coupled to a gas flow regulator sliding member, whereby the flow of gas into a container containing a beauty treatment solution is regulated to control the rate at which the solution is foamed. Accordingly, a large amount of the foam can be applied as rapidly as possible to the top of the head where the foam is easily applicable, whereas for application to portions, such as the back and side of the head, where the foam is liable to flow down if applied in a large amount, the solution is foamed at a reduced rate so as to be applicable at a lower rate. Thus, the foam spray of this invention has the advantage of assuring efficient application of the foam in accordance with the particular condition involved.

An object of this invention is to provide a foam spray for beauty treatment in which the beauty treatment solution can be foamed at a readily controllable rate so that the foam is applicable efficiently in accordance with the work condition.

Another object of this invention is to facilitate the application of the foam at a controlled rate of foaming by automatically maintaining the controlled rate.

Still another object of this invention is to provide a foam spray for beauty treatment including a foaming gas cylinder which can be refilled to thereby render the spray inexpensive to maintain and to manufacture.

Other objects and advantages of this invention will become apparent from the following description.

BRIEF DESCRIPTION OF THE DRAWINGS

The foam spray for beauty treatment according to this invention will be described below with reference to the accompanying drawings showing the spray as used for the application of a cold wave solution.

DESCRIPTION OF THE PREFERRED EMBODIMENTS

Figure 1:
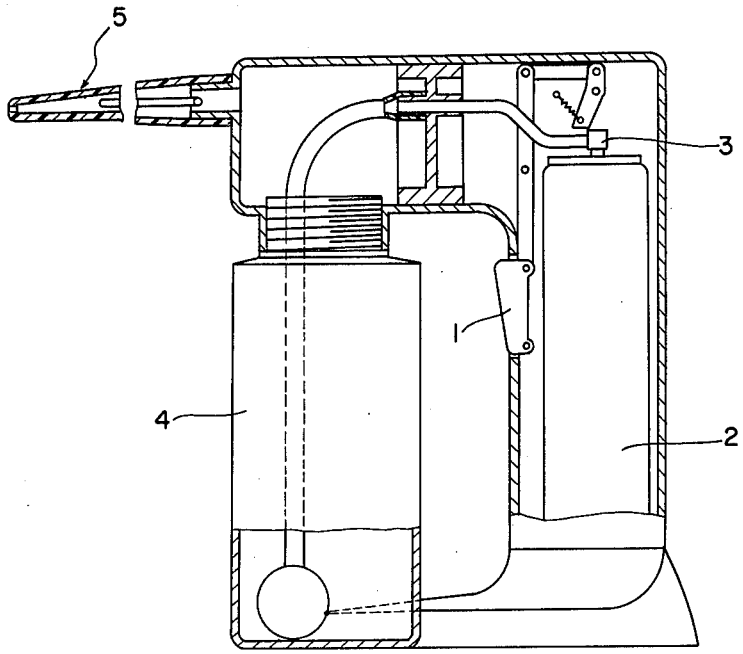
Fig. 1 (Prior Art)
FIG. 1 is an overall side elevation in vertical section partly broken away and showing a spray main body in accordance with the prior art.
Figure 2:
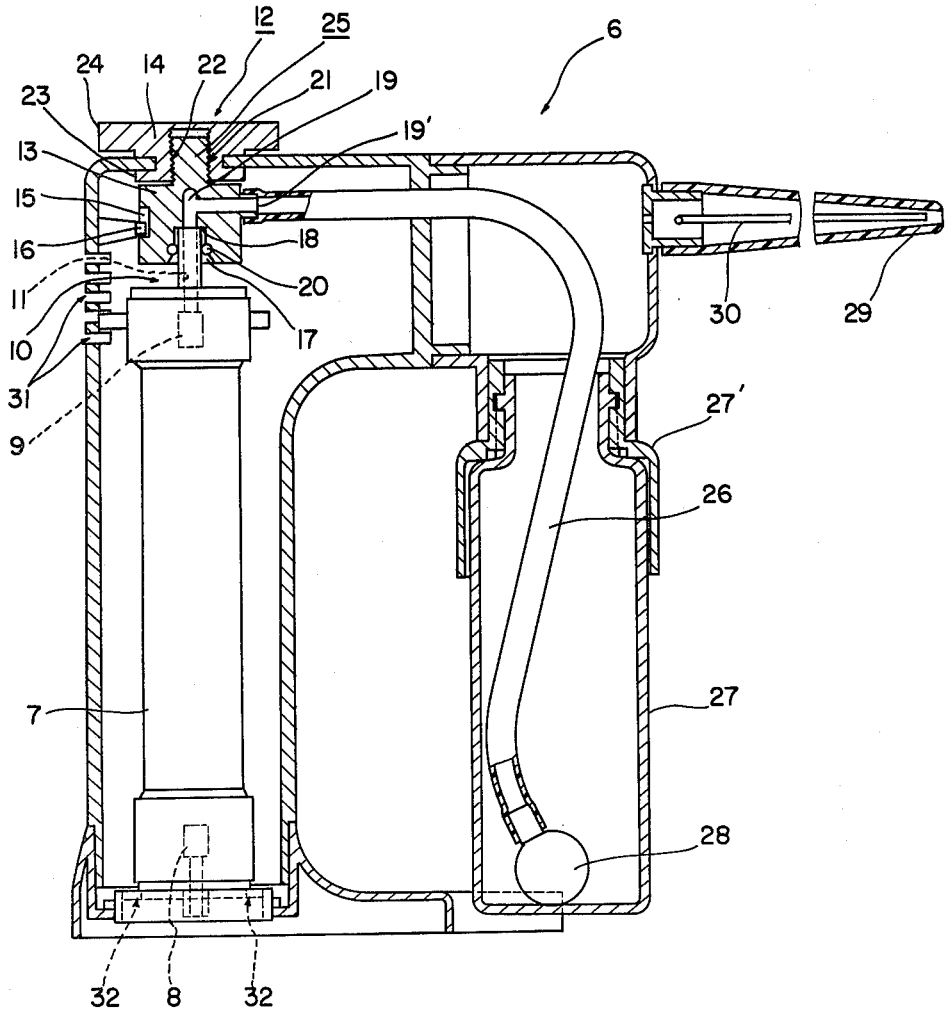
FIG. 2 is an overall side elevation in vertical section partly broken away and showing a spray main body according to this invention.

FIG. 2 shows the main body 6 of a foam spray for beauty treatment housing a gas cylinder 7 which can be refilled and which is fixedly installable in the main body 6 from its lower portion. The cylinder 7 has an inlet valve 8. The gas cylinder 7 preferably has a capacity of up to 10 c.c. sufficient to contain an amount of gas required for applying a permanent wave solution to one person. Such cylinder is convenient and inexpensive to use. It is also preferable to admix a perfume with the gas to deodorize the permanent wave solution. The gas cylinder 7 has a valve 9 of the stem type (the interior not shown) which is axially movable to discharge the gas through a passage 11 extending through a valve stem 10.

It has been found that the rate of discharge of gas can be regulated if it is possible to ingeniously alter the axial displacement of the valve stem by degrees. Indicated at 12 is a gas flow regulator comprising a slidable member 13 only slidable in its axial direction and a rotatable member 14 which is free to rotate only. The slidable member 13 has a key groove 15 having engaged therein a projection 16 projecting from the spray main body 6 so as to be movable only axially thereof. The slidable member 13 is further formed in its lower portion a bore 17 for retaining the valve stem 10 of the gas cylinder 7 fitting therein. At an inner portion of the bore 17, there is formed a stepped portion 18 bearing against a thick portion of the valve stem 10. The bore 17 communicates with a passageway 19 having an outlet 19' at a side portion of the slidable member 13. Fitted in the bore 17 is an O-ring 20 by which the gas discharged from the valve stem 10 into the passageway 19 is prevented from flowing reversely downward from the bore 17. An externally threaded portion 21, having threads of small pitch, projects from one side of the slidable member 13 opposite to the bore 17 and extends axially of the member 13. On the other hand, the rotatable member 14 has an internally threaded portion 22 extending coaxially therewith and in screw-thread engagement with the externally threaded portion 21 of the slidable member 13. The rotatable member 14 is provided with a restraining portion 23 for preventing the axial movement of the member 14 but permitting only the rotation thereof and also provided with a knob member 24 positioned outside the spray main body 6 for discharging the pressure gas. Indicated at 25 is gas discharge position maintaining means, namely a retainer, comprising the threaded portions 21 and 22. The threads of these portions having a small pitch ensures the desired function of the retainer 25. A pipe 26 has one end connected to the outlet 19' in a side portion of the slidable member 13 and the other end extending into a container 27 containing a cold wave solution and attached to the spray main body 6. The spray main body 6 has a mount 27' for the container 27. A foam generator 28 for releasing the gas from the pipe 26 is made by sintering finely divided stone. A nozzle 29 made of rubber for discharging the foam communicates with the interior of the container 27 and is provided therein with a reinforcing member 30 for regulating the direction of discharge of the foam.

The spray main body 6 has air inlets 31 serving to prevent a reduction in the temperature of the air surrounding the gas cylinder 7 due to the vaporization of the liquefied gas and to thereby ensure smooth vaporization. Fresh air is admitted from above through the air inlets 31, whereby the cooled air surrounding the gas cylinder 7 and flowing downward is forced out through air outlets 32 in a lower portion of the main body 6.

The foam spray operates in the following manner. The container 27 containing a permanent wave solution serving as a treatment solution is installed in the spray main body 6. The rotatable member 14 the gas flow regulator 12 is then turned, permitting the rotatable member 14 to rotate only, due to the presence of the restraining portion 23. Although the rotatable member 14 acts to turn the slidable member 13 in screw-threaded engagement therewith, the slidable member 13, which is restrained by the projection 16 in engagement therewith, is moved downward. The valve stem 10 of the gas cylinder 7, bearing against the stepped portion 18 in the bore 17 of the slidable member 13, is forced down by this movement, opening the valve 9. The gas therefore flows from the passage 11 of the valve stem 10 into the container 27 by way of the passageway 19 and the pipe 26 and foams the permanent wave solution. In this procedure, the gas flow regulator 12, by virture of the screw-threaded engagement involved therein, can depress the valve stem 10 by degrees, so that the rate of the outflow of the gas allowed by the lowered valve stem 10 is controllable. Although the spring incorporated in the valve stem 10 acts to return the stem 10 upon the manipulation of the knob member 24 to move the slidable member 13 upward, the engagement between the threaded portions 21 and 22 having threads of small pitch, namely the retainer 25, prevents the upward movement, automatically retaining the valve stem 10 in the gas discharge position. Thus, the knob member 24, merely by being manipulated only once, can control the rate of flow of the gas from the cylinder 7 and is automatically held in its manipulated position. The knob member 24 is therefore releasable from the hand. Because the treatment solution is foamable at a controlled rate, the user can apply a desired amount of foam to the head by an easy procedure.

Figure 3:
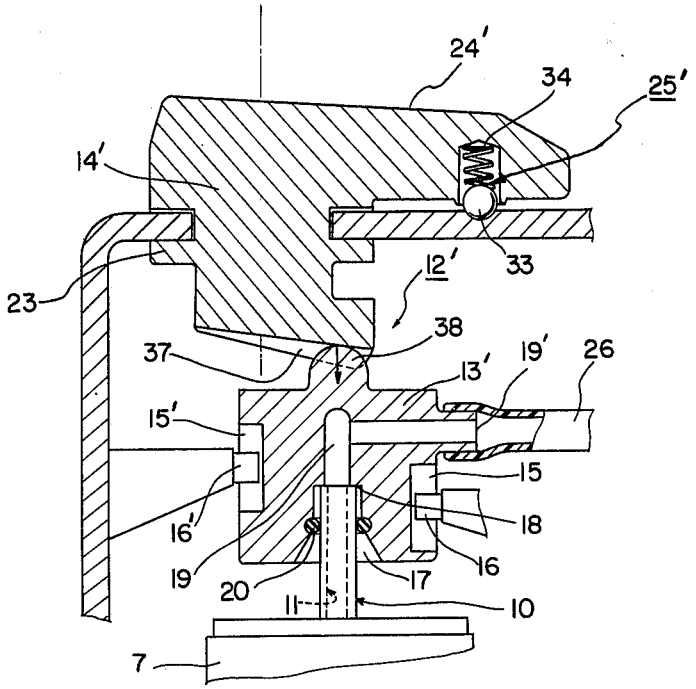
FIG. 3 is an enlarged side elevation in vertical section partly broken away and showing other embodiments of gas flow regulator and gas discharge position maintaining means.
Figure 4:
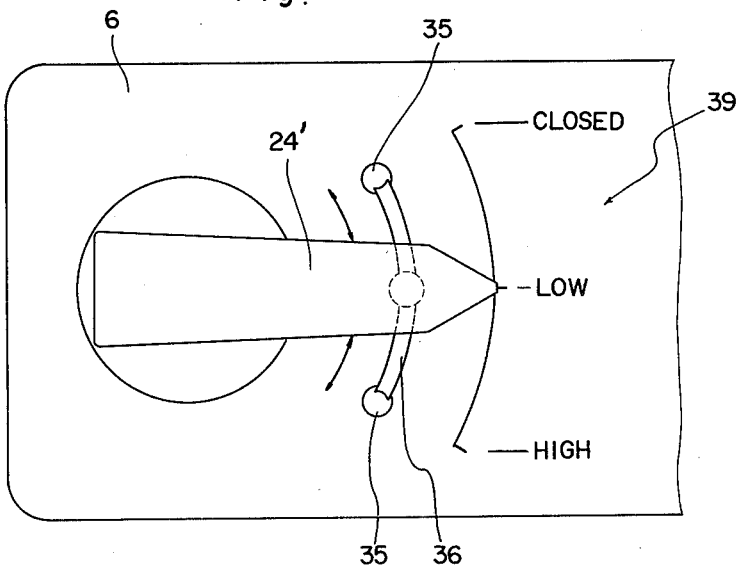
FIG. 4 is a plan view of FIG. 3.

With reference to FIGS. 3 and 4, other embodiments of the foregoing gas flow regulator and the gas discharge position maintaining means, i.e. retainer, will be described below. Throughout the accompanying drawings, like parts are referred to by like reference numerals.

The rotatable member 14' is provided with a ball 33 which is biased by a spring 34 toward the spray main body 6. The ball 33 is fittable in recesses 35 formed in the upper surface of the spray main body 6 to retain the rotatable member 14' in predetermined positions. These elements constitute a retainer 25'similar in function to the elements 21, 22 of the embodiment of FIG. 2. The spray main body 6 is further formed in its upper surface with a guide groove 36 having a smaller depth than the recesses 35 and interconnecting the recesses. The rotatable member 14' has on its lower portion a cam surface 37 which is in contact with a portion 38 on the upper surface of the slidable member 13'. An indicator 39 indicates the position of the rotatable member 14' when the member 24' is manipulated.

When the foamed permanent wave solution is to be applied, for example, to the back or side of the head, the rotatable member 14' is turned to the position LOW shown, whereupon the ball 33 on the rotatable member 14' fits into the recess 35 at the LOW position under the action of the spring 34 and is retained in that position. The turning of the rotatable member 14' turns the cam surface 37 integral therewith, depressing the portion 38 of the slidable member 13' in contact with the surface 37 as indicated by the arrow in FIG. 3. The slidable member 13' restrained by the projection 16 and an opposite projection 16' in key grooves 15, 15', respectively, is therefore slightly moved downward. The member 13' in turn slightly moves down the valve stem 10 bearing thereagainst, opening the valve of the gas cylinder 7 to a small extent, whereupon the gas in the cylinder 7 to a small extent, whereupon the gas in cylinder 7 flows at a low rate into the container containing a permanent wave solution. Further when efficient application of the foam is desired at an increased rate as for the top of the head, the knob member 24' is turned to the HIGH position, depressing the valve stem 10 further downward and permitting an increased amount of gas to flow into the container to accelerate the foaming of the solution.

In this way, the objects of this invention are attainable also with use of the rotatable member 14' of the cam type and the retainer 25' of the ball type. Since the gas discharge position can be automatically maintained upon manipulation of the rotatable member for the discharge of the gas, the foaming rate, when adjusted to LOW or HIGH, can be thereafter maintained at the adjusted value even if the knob member is released from the hand. The foam is therefore applicable with ease.

What is claimed is:

1. A foam spray for hair beauty treatment comprising
- a spray main body (6) having a mount (27') and a grip,
- a container (27) attached to said mount (27') and containing a hair beauty treatment solution,
- a gas cylinder (7) mounted in said spray main body (6),
- a valve (9) provided on said gas cylinder (7);
- a gas flow regulator (12) operatively connected to said valve (9) to control foaming rate in said container (27);

a flow regulator retainer (25) to maintain said valve (9) in operative position for gas discharge, a flow regulator rotatable member (14) adapted to adjust said gas flow regulator (12), a restraining portion (23) on said rotatable member (14) for permitting only turning thereof, said gas flow regulator further comprising a first threaded portion (22) integral with said rotatable member (14) and a slidable member (13) having a second threaded portion (21) adapted for screw-thread engagement with said first threaded portion (22), said slidable member (13) being formed with a groove (15) extending axially of a valve stem (10) of said gas cylinder (7) and having engaged therein a projection (16) extending from said spray main body (6), said valve stem (10) being slidable axially thereof, and a foam generator (28) positioned on the bottom of said container (27) and adapted to introduce gas from said gas cylinder (7) into said container (27) to foam up said hair beauty treatment solution.

2. A foam spray for beauty treatment as defined in claim 1 wherein the retainer (25) comprises the first and second threaded portions (22) and (21) having threads of small pitch, whereby the valve stem (10) is prevented from returning in its axial direction against the force of a spring incorporated therein.

3. A foam spray for beauty treatment as defined in claim 2 wherein the slidable member (13) is further formed with a bore (17) having the valve system (10) fitted therein, a stepped portion (18) provided at an inner portion of the bore (17) and bearing against a thick portion of the valve stem (10), and a passageway (19) communicating with a passage (11) in the valve stem (10) and having an outlet (19') in a side portion of the slidable member (13), a pipe (26) in communication with the container (27) being connected to the outlet (19').

4. A foam spray for hair beauty treatment comprising a spray main body (6) having a mount (27') and a grip, a container (27) attached to said mount (27') and containing a hair beauty treatment solution, a gas cylinder (7) mounted in said spray main body (6), a valve (9) provided on said gas cylinder (7); a gas flow regulator (12) operatively connected to said valve (9) to control foaming rate in said container (27), a flow regulator retainer (25') to maintain said valve (9) in operative position for gas discharge, a flow regulator rotatable member (14') adapted to adjust said gas flow regulator (12'), said gas flow regulator (12') further comprising a cam surface (37) and a restraining portion (23) formed with said rotatable member (14') for permitting only turning of said rotatable member (14'), and a slidable member (13) having a portion (38) in contact with said cam surface (37), said slidable member (13) being formed with a groove (15) extending axially of a valve stem (10) of said gas cylinder (7) and having engaged therein a projection (16) extending from said spray main body (6), said valve stem (10) of said gas cylinder (7) being slidable axially thereof, and a foam generator (28) positioned on the bottom of said container (27) and adapted to introduce gas from said gas cylinder (7) into said container (27) to foam up said hair beauty treatment solution.

5. A foam spray for beauty treatment as defined in claim 4 wherein the retainer (25) comprises a ball (33) provided on the rotatable member (14') and recesses (35) formed in the spray main body (6), the ball (33) being biased toward the recesses (35) by a spring (34).

6. A foam spray for beauty treatment as defined in claim 5 wherein the slidable member (13) is further formed with a bore (17) having the valve stem (10) fitted therein, a stepped portion (18) provided at an inner portion of the bore (17) and bearing against a thick portion of the valve stem (10), and a passageway (19) communicating with a passage (11) in the valve stem (10) and having an outlet (19') in a side portion of the slidable member (13), a pipe (26) in communication with the container (17) being connected to the outlet (19').

* * * * *